US005975164A

United States Patent [19]

Whaley et al.

[11] Patent Number: 5,975,164

[45] Date of Patent: Nov. 2, 1999

[54] NOZZLE FOR DISPENSING CONTAINER AND RECEPTACLE FOR RECEIVING SAME

[75] Inventors: Robert E. Whaley, Cocoa; Donald L. Acker, Lakeland; Conrad L. Williams, Bartow, all of Fla.

[73] Assignee: Orange-co of Florida, Inc., Bartow, Fla.

[21] Appl. No.: 09/133,347

[22] Filed: Aug. 13, 1998

[51] Int. Cl.[6] ..... B65B 1/04

[52] U.S. Cl. ..... 141/351; 141/352; 141/364; 141/366; 141/346; 251/149.7; 251/149.6

[58] Field of Search ..... 141/351–356, 141/363, 364, 365, 366, 346; 251/149.6, 149.7; 137/533.13, 528, 539; 222/481, 83.5, 61, 185; 366/130

[56] References Cited

U.S. PATENT DOCUMENTS

| | | | |
|---|---|---|---|
| 2,682,281 | 6/1954 | Ecker | 137/533.13 |
| 4,216,885 | 8/1980 | Sedam | 222/481 |
| 4,376,496 | 3/1983 | Sedam et al. | 222/83.5 |
| 4,583,664 | 4/1986 | Bayat | 222/61 |
| 4,601,305 | 7/1986 | Nordskog | 137/528 |
| 4,614,437 | 9/1986 | Buehler | 366/130 |
| 5,107,890 | 4/1992 | Gute | 137/539 |
| 5,405,058 | 4/1995 | Kalis et al. | 222/185 |
| 5,425,404 | 6/1995 | Dyer | 141/351 |

*Primary Examiner*—Steven O. Douglas
*Assistant Examiner*—Khoa Huynh
*Attorney, Agent, or Firm*—Carlton Fields et al.

[57] ABSTRACT

A nozzle for a container including an internal ball check valve along with an o-ring sealing structure and angled insertion limitation stops to cooperate with a receptacle to permit the insertion of the nozzle and container only a predetermined distance, while providing for such insertion to effect an opening of the ball check valve, and appropriate sealing o-rings are provided to prevent leakage of the liquid past the nozzle.

4 Claims, 2 Drawing Sheets

NOZZLE FOR DISPENSING CONTAINER AND RECEPTACLE FOR RECEIVING SAME

BACKGROUND OF THE INVENTION

This invention related to the combination of a nozzle attachable to a fitting on a dispensing container and a receptacle for receiving such a nozzle to dispense liquid from the container into a receptacle.

It is known in containers, such as bottles or bags containing various liquids, such as concentrates for drinks, to use dispensing nozzles of various types that are receivable into receptacles in the dispensing apparatus. Typical of these applications have been the large containers for milk dispensers in which a tube extends out the bottom of the container and is received within a pinching apparatus to control the flow of such milk. Other alternatives have included various caps or nozzles that cooperate with different types of receptacles, as illustrated in Bayat, U.S. Pat. No. 4,583,664, and Sedam et al., U.S. Pat. No. 4,376,496. While various of these nozzle and receptacle combinations have proved more or less satisfactory, various difficulties have appeared in the use of those nozzles, including leakage through the nozzle either before or during installation of the container onto a dispenser. Additionally, many of those prior art structures required difficult installation of the container into the receptacle, some even requiring threading the container onto the receptacle, which rendered the process even slower and more prone to spillage.

SUMMARY OF THE INVENTION

It is an object of the present invention to provide an improved nozzle for attachment to a downward facing fitting on a dispensing container for easier receipt into a receptacle into which the liquid of the container is dispensed. It is a further object to provide such a combination of nozzle and receptacle that provides for easy insertion and reduced likelihood of spillage of the liquid.

To achieve these and other objects, which will become apparent, this invention provides the combination of a nozzle and a receptacle for at least the outer end of such nozzle, which nozzle is attachable to a downward facing portion of a dispensing container and is received into a cylindrical receptacle having a central axis and a predetermined internal radius. This nozzle comprises an internally threaded cylindrical first portion having a central axis and being of predetermined radius, whereby that first portion may be threadably received onto a corresponding externally threaded fitting on the container. The nozzle further includes a second cylindrical portion extending coaxially with and outwardly from the nozzle first portion and a plurality of discrete stops extending angularly outwardly from the outer surface of a second portion of the nozzle and angled outwardly in a direction away from the outer end of that second portion a radial distance greater than the internal radius of the receptacle so that the angular stops not only direct and center insertion of the nozzle second portion into the receptacle but also prevent insertion of the nozzle portion beyond a predetermined insertion distance. The second cylindrical portion of the nozzle extends coaxially with and outwardly from the first portion, with an inner part thereof proximal the nozzle first portion and an outer part distal the nozzle first portion, that nozzle second portion having a predetermined outer radius smaller than said first radius and smaller than said cylindrical receptacle internal radius. The outer part of said cylindrical portion includes an o-ring groove and an o-ring having a round cross section received in that groove and extending radially outwardly of the nozzle second portion a distance greater than the radial distance of the outer surface of the second portion from the central axis and greater than the radial distance of the inner surface of the receptacle from its central axis, whereby insertion of the nozzle second portion into the receptacle provides a resiliently sealing engagement between the o-ring and the inner surface of the receptacle.

BRIEF DESCRIPTION OF THE DRAWINGS

A particularly preferred embodiment of the present invention will be described in detail below in connection with the drawings in which.

DESCRIPTION OF A PREFERRED EMBODIMENT

Figure 1:
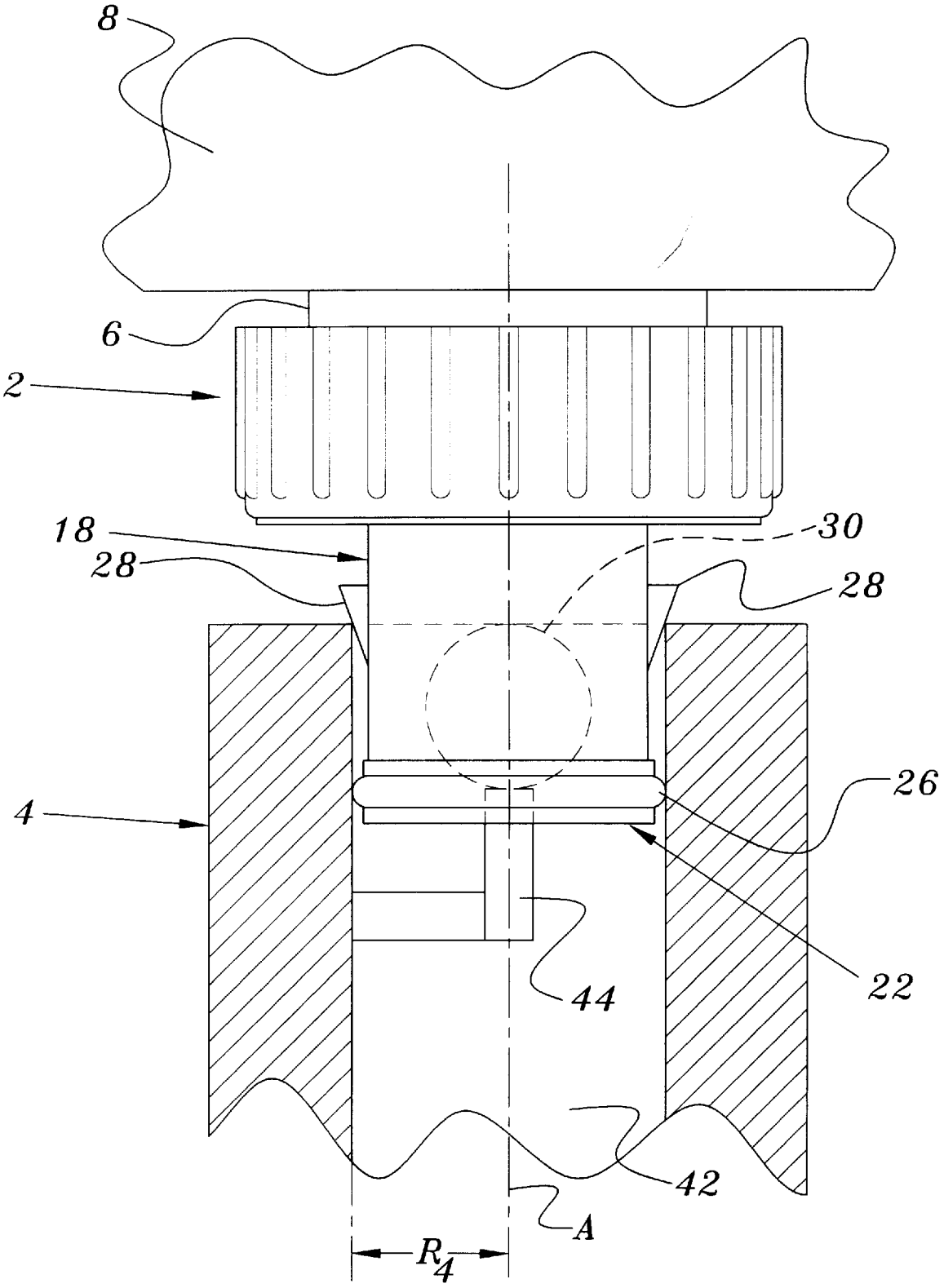
FIG. 1 is a side view, on an enlarged scale, of the nozzle and receptacle combination of the present invention, with the receptacle shown in section.

A preferred embodiment of the nozzle and receptacle combination of the present invention is illustrated in FIG. 1, in which reference numeral 2 generally indicates the nozzle and reference numeral 4 indicates the receptacle, which may be of any configuration but conveniently is shown for purposes of illustration as a cylindrical member, illustrated in section in FIG. 1. In this figure nozzle 2 is illustrated attached to a fitting 6 extending downwardly from a conventional container 8, which may be of any suitable configuration and material.

Figure 2:
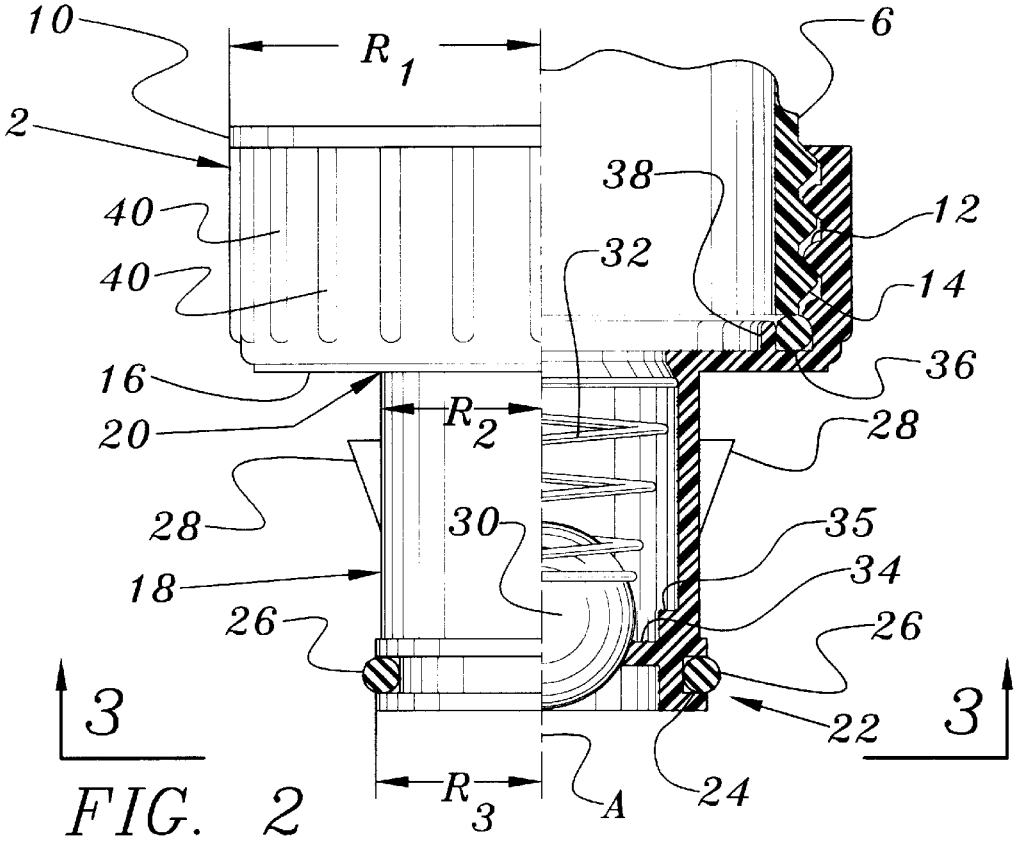
FIG. 2 is a side view of the nozzle and container of FIG. 1, shown partially in section to illustrate the internal configuration.
Figure 3:
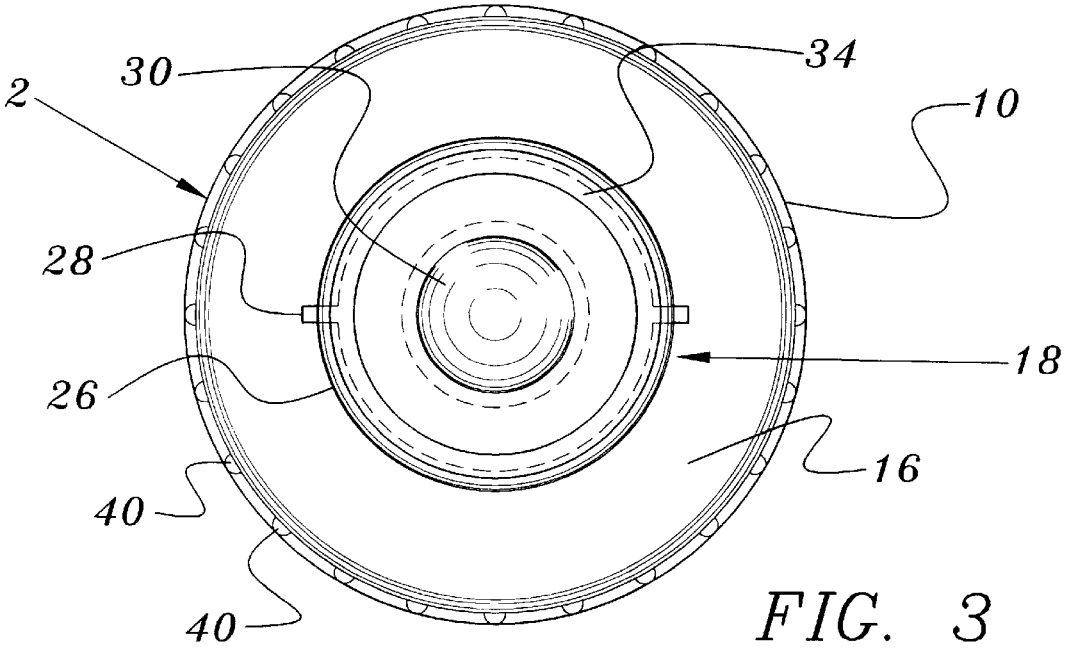
FIG. 3 is an end view of the nozzle of FIG. 2, taken along line 3—3.

Nozzle 2 may conveniently be formed of any suitable material, preferably a synthetic resin, which may suitably be polyethylene or polypropylene. As shown in FIGS. 2 and 3, the nozzle 2 includes a first portion 10 of generally cylindrical configuration having a central axis A and being of a predetermined radius R-1. As best shown in FIG. 2, this first portion is generally of the form of a hollow cylinder having internal threads 12 that are dimensioned and configured to be threadably received onto corresponding external threads 14 on the container fitting 6.

The nozzle first portion 10 also includes a shoulder portion 16 extending between the internally threaded cylindrical outer wall and a second cylindrical portion 18, which is coaxial with and projects outwardly (downwardly in FIGS. 1 and 2) from nozzle first portion 10. An inner part 20 of that second cylindrical portion is shown proximal the nozzle first portion, with an outer part 22 distal that nozzle first portion. As shown in FIGS. 1–3, the nozzle second portion has a predetermined external radius R-2 that is smaller than the radius R-1 of the first portion.

As shown most clearly in FIG. 2, the outer part 22 of the nozzle second portion includes a groove 24 into which is received an o-ring 26, preferably having a round cross section and formed of a conventional resilient synthetic resin, such as neoprene. As mounted in the groove 24, the o-ring 26 extends radially outwardly of the nozzle second portion a distance R-3 greater than the radial distance of the outer surface of that nozzle second portion from the central axis.

Also on the outer surface of the second portion 18 of the nozzle are provided, suitably by molding integrally therewith, a plurality of stops extending angularly outwardly from that outer surface, angled outwardly in a direction away from the distal outer part of the nozzle and away from the axis A, for purposes to be described below.

As shown in the sectional view of FIG. 2, the nozzle includes a ball member 30 resiliently biased by spring 32 against a valve seat 34 to resiliently close a passage extending along the central axis. Accordingly, unless the ball 30 is urged away from the seat 34, no liquid may flow out of the nozzle. Also as shown in the fragmentary sectional view of FIG. 2 there are provided a plurality of ball centering lugs 35, suitably in the form of angled ribs extending angularly inwardly from the inner surface of the nozzle second portion 18 toward the ball seat 34. While only a single such rib 35 is shown in the fragmentary sectional view of FIG. 2, it is to be understood that there are provided a plurality of such ball centering lugs 35 positioned around the inner surface of the nozzle second portion 18.

Also shown in the sectional view of FIG. 2 is a second o-ring 36 held in place between the internally threaded outer portion 10 and a ridge 38, which may suitably be molded integrally with the nozzle. This second o-ring 36, positioned adjacent the end of the internal threads, engages the fitting 6 of the container to seal the joint between that fitting 6 and the nozzle 2.

As is shown most clearly in FIG. 3, the nozzle also includes a plurality of ribs 40, which may conveniently be molded into the nozzle first portion 10 to provide for a better grip by a person fitting the nozzle onto the fitting 6.

FIG. 1 illustrates the manner in which the nozzle 2, connected to a fitting 6 on container 8, may be received into a receptacle 4, which has a radius R-4 on its internal bore. The relative dimensions of the receptacle and the nozzle are selected such that the nozzle outer part 22, and suitably all of the second portion 18, is of a radius smaller than the radius R-4 of the interior of the receptacle 4. Additionally, the outer diameter R-3 of the installed o-ring 26 is selected such that in its normal, uncompressed state, it extends outwardly a radius R-3 from the central axis A greater than the radial distance R-4 of the inner surface of that receptacle 4 from the central axis A, whereby insertion of that nozzle second portion into the receptacle 4 provides a resiliently sealing engagement between the o-ring 26 and the inner surface 42 of the receptacle.

Also as shown in FIG. 1, the outwardly angled stop extends angularly outwardly from the outer surface of the second portion 18 of the nozzle a radial distance greater than the internal radius R-4 of the receptacle 4. Thus, with the plurality of such stops 28 (two of which are shown in the figures), the angular stops not only direct and center insertion of the nozzle second portion into the receptacle, but also prevent insertion of the nozzle portion beyond a predetermined insertion distance. These relationships cooperate with a member 44, which may conveniently be affixed to the side of or otherwise within the internal bore 42 of the receptacle 4, and extends in a direction toward the outer (top in FIG. 1) end of that receptacle 4. The member 44 is preferably sized, particularly in the length axial of the center axis A, a distance such that, upon insertion of a container 8 carrying the nozzle of this invention, that member 44 will urge the ball 30 of the ball check valve in a direction away from the check valve seat 34 a predetermined distance, which distance is sufficient to open the fluid flow passage past that ball check valve when the nozzle is inserted into the receptacle an appropriate distance not greater than the maximum insertion depth permitted by the angled stops 28, as shown in FIG. 1. Thus, such insertion of the nozzle will permit fluid flow past the ball check valve when it is inserted into the receptacle, and removal of the nozzle from the receptacle 4 and its member 44 will permit the ball 30 to re-seat, thus stopping any further flow of fluid past the ball check valve.

While the foregoing illustrates a particularly preferred embodiment of the nozzle of this invention, with its cooperating receptacle, it is to be understood that the described embodiment is illustrative only of the principles of this invention and is not to be considered limitative thereof. Accordingly, because numerous variations and modifications of this structure will readily occur to those skilled in the art, the scope of this invention is to be limited solely by the claims appended hereto.

What is claimed is:

1. The combination of a nozzle and a receptacle for at least the outer end of said nozzle, with said nozzle being attachable to an externally threaded fitting on a dispensing container and being received into a cylindrical said receptacle having a central axis and a predetermined internal radius, said nozzle comprising an internally threaded cylindrical first portion of generally cylindrical configuration having a central axis and being of a predetermined radius, whereby such first portion may be threadably received onto a corresponding externally threaded fitting on a container;

a second hollow cylindrical portion extending coaxially with and outwardly from said first portion and toward said outer end, with an inner part thereof proximal said nozzle first portion and an outer part distal said nozzle first portion, said nozzle second portion having a predetermined radius smaller than said first radius and smaller than said cylindrical receptacle internal radius;

said outer part of said second portion having an o-ring groove;

an o-ring having a round cross section and being received in said groove and extending radially outwardly of said nozzle second portion a distance greater than the radial distance of the outer surface of said second portion from said central axis and greater than the radial distance of the inner surface of said receptacle from said central axis, whereby insertion of the nozzle second portion into said receptacle provides a resiliently sealing engagement between the o-ring and the inner surface of the receptacle;

a plurality of discrete stops spaced about and extending angularly outwardly from said outer surface of said second portion and angled outwardly in a direction away from said distal end a radial distance greater than said internal radius of said receptacle, such that said angular stops not only direct and center insertion of said nozzle second portion into said receptacle but also prevent insertion of said nozzle portion beyond a predetermined insertion distance.

2. The combination of claim 1 wherein said nozzle includes a spring-biased internal ball check valve having a biasing member urging said ball against a seat to resiliently close a passage extending along said central axis, such that an external element may engage and unseat said ball to open said passage to fluid flow.

3. The combination of claim 2 wherein said ball check valve is positioned within said second hollow cylindrical portion, and wherein said second hollow cylindrical portion includes on the inner surface thereof a plurality of ball centering lugs extending angularly inwardly from said inner surface toward said ball check valve seat and said nozzle outer end, whereby the ball centering lugs aid in directing the ball toward the center of the check valve seat.

4. The combination of claim 1 wherein said first portion includes an o-ring seat to receive an o-ring adjacent the end of said internal threads proximal said nozzle second section, such that said o-ring engages the outermost end of said dispensing container to provide a sealing engagement between the nozzle first portion and the container.

* * * * *